US007431594B2

(12) United States Patent
Castaldo et al.

(10) Patent No.: US 7,431,594 B2
(45) Date of Patent: Oct. 7, 2008

(54) TELESCOPING WEATHER RESISTANT BOX

(75) Inventors: Cosmo Castaldo, Westbury, NY (US); Marc Noest, Westbury, NY (US); Peter Galluci, Brightwaters, NY (US)

(73) Assignee: Leviton Manufacturing Co., Inc., Little Neck, NY (US)

( * ) Notice: Subject to any disclaimer, the term of this patent is extended or adjusted under 35 U.S.C. 154(b) by 0 days.

(21) Appl. No.: 11/559,875

(22) Filed: Nov. 14, 2006

(65) Prior Publication Data

US 2007/0128915 A1 Jun. 7, 2007

Related U.S. Application Data

(60) Provisional application No. 60/736,798, filed on Nov. 15, 2005.

(51) Int. Cl.
*H01R 13/44* (2006.01)

(52) U.S. Cl. ..... 439/135; 439/144; 174/67

(58) Field of Classification Search ..... 439/135, 439/136, 142, 144; 174/67; 220/242
See application file for complete search history.

(56) References Cited

U.S. PATENT DOCUMENTS

| | | | | |
|---|---|---|---|---|
| 3,636,498 | A | 1/1972 | McQuarrie | |
| 4,451,101 | A * | 5/1984 | Davis | 439/144 |
| D274,721 | S | 7/1984 | Smith | |
| 4,567,544 | A | 1/1986 | Ronemus et al. | |
| D297,136 | S | 8/1988 | Collins et al. | |
| 4,803,307 | A | 2/1989 | Shotey | |
| 4,874,906 | A | 10/1989 | Shotey | |
| D305,531 | S | 1/1990 | Suzuki et al. | |
| 4,988,832 | A | 1/1991 | Shotey | |
| 5,045,640 | A * | 9/1991 | Riceman | 174/67 |
| 5,148,348 | A * | 9/1992 | White | 361/658 |
| D332,088 | S | 12/1992 | Nimpoeno et al. | |
| D335,650 | S | 5/1993 | Powell et al. | |
| D335,866 | S | 5/1993 | Powell et al. | |
| 5,228,584 | A | 7/1993 | Williams, Jr. | |
| D339,794 | S | 9/1993 | Powell et al. | |
| 5,272,297 | A | 12/1993 | Reichow et al. | |
| 5,280,135 | A | 1/1994 | Berlin et al. | |
| 5,380,956 | A | 1/1995 | Loo et al. | |
| 5,477,010 | A | 12/1995 | Buckshaw et al. | |
| 5,564,592 | A * | 10/1996 | Martin et al. | 220/724 |
| 5,568,344 | A | 10/1996 | Gernhardt et al. | |
| 5,605,466 | A * | 2/1997 | Devlin et al. | 439/144 |
| 5,680,287 | A | 10/1997 | Gernhardt et al. | |
| D385,850 | S | 11/1997 | DiMichele | |
| 5,684,272 | A | 11/1997 | Gernhardt et al. | |
| 5,711,066 | A | 1/1998 | Castaldo | |
| 5,712,450 | A | 1/1998 | Chan et al. | |
| 5,773,760 | A | 6/1998 | Stark et al. | |
| 5,857,873 | A | 1/1999 | Castaldo | |

(Continued)

OTHER PUBLICATIONS

"Industrial Watertight Wiring Devices", Leviton Industrial Products Division, www.leviton.com (2002).

*Primary Examiner*—Thanh-Tam T Le
(74) *Attorney, Agent, or Firm*—Carter, DeLuca, Farrell & Schmidt, LLP

(57) ABSTRACT

A weather resistant telescoping enclosure for enclosing a receptacle or other device is provided that comprises a telescoping cover over an enclosed base portion and an irregularly shaped cutout on its mounting surface that permits positioning of the base portion over an existing device installation with increased mobility.

9 Claims, 6 Drawing Sheets

U.S. PATENT DOCUMENTS

| | | | | |
|---|---|---|---|---|
| 5,864,455 | A | 1/1999 | Gernhardt et al. | |
| D437,586 | S | 2/2001 | Sonntag | |
| 6,806,426 | B1 * | 10/2004 | Gretz | 174/67 |
| D507,241 | S | 7/2005 | Koessler | |
| 6,956,176 | B2 | 10/2005 | Castaldo | |
| 6,979,777 | B2 * | 12/2005 | Marcou et al. | 174/50 |
| 7,038,131 | B1 | 5/2006 | Gretz | |
| 7,115,820 | B1 * | 10/2006 | Gretz | 174/481 |
| 7,129,412 | B2 * | 10/2006 | Pierce | 174/66 |
| D532,380 | S | 11/2006 | Castaldo et al. | |
| 2006/0016809 | A1 | 1/2006 | Dinh et al. | |

* cited by examiner

TELESCOPING WEATHER RESISTANT BOX

This application claims the benefit of the filing date of a provisional application having Ser. No. 60/736,798 which was filed on Nov. 15, 2005.

BACKGROUND OF THE INVENTION

1. Field of the Invention

The present invention is directed to a telescoping weather-resistant enclosure that expands to accommodate plugs and wire when necessary but can be compressed when not in use to reduce its overall dimensions.

2. Description of the Prior Art

Telescoping enclosures are well known in the prior art and are used to protect electrical devices from the elements and tampering. Typically a telescoping enclosure comprises a box-like structure with a hinged cover that is mounted on a wall such that it encloses a receptacle or other electrical devices. The enclosure usually has slots in the cover portion to accommodate wires that are attached to plugs that are housed in the enclosure when in use. In general, telescoping enclosures have covers that are height adjustable and which telescope to increase the available space within the enclosure, thereby allowing the enclosure to accommodate one or more plugs in the receptacle housed within the enclosure.

When the receptacle is not in use, and plugs are not connected to the receptacle in the enclosure, the cover can be lowered, thereby decreasing the height of the box and its overall profile. Some prior art telescoping enclosures are designed to be installed without removing the receptacles that they are intended to enclose. This is made possible by mounting holes formed in the base of the enclosure that are large enough to accommodate the mounting screws of the receptacle to be enclosed by the housing when they are loosened. Thus, in order to mount the enclosure, a user loosens the mounting screws of the receptacle to be housed within the enclosure, places the oversized mounting holes in the base of the enclosure around the loosened mounting screws and then tightens the loosened receptacle screws to secure both the receptacle and the enclosure in place.

While enclosures of the type described are beneficial and work well, some drawbacks in prior art enclosures are prevalent. For example, in some prior art enclosures that can be mounted with a receptacle already in place, the permissible range of movement that can be employed when trying to mount the enclosure on an installed receptacle is limited to that afforded by the linear extent of a keyhole screw mount. In a tight mounting situation, the limited horizontal or vertical movement allowed by a keyhole slot does not afford a user the flexibility required to fit an enclosure over an already mounted receptacle.

Another drawback related to some prior art enclosures is that in many instances the enclosure cover is mounted to its base by slots formed in the sides of the base which engage rails formed in the enclosure cover to allow the cover to slide along the slots, thereby modifying the height of the enclosure. While this arrangement is functional, the relatively close tolerances between the rails in the enclosure cover and the slots in the base can lead to binding when a user tries to expand the enclosure. A need therefore exists for a telescoping enclosure that obviates these drawbacks.

SUMMARY OF THE INVENTION

The invention is directed to a telescoping weather-resistant enclosure that allows a greater range of movement during installation over a mounted receptacle than conventional telescoping enclosures and which incorporates a floating hinge in the enclosure cover that allows the cover to extend automatically when cords are present in the enclosure.

In another embodiment of the present invention, a telescoping weather-resistant enclosure comprises a base that fixedly attaches to a wall mounted receptacle and a domed cover removably attached to the base wherein the domed portion of the cover creates additional volume in the interior of the enclosure.

Other features of the invention will be pointed out in the following description and claims and illustrated in the accompanying drawings, which disclose, by way of example, the principle of the invention and the best mode which is presently contemplated of carrying them out.

BRIEF DESCRIPTION OF THE DRAWINGS

In the drawings in which similar elements are given similar reference characters.

DETAILED DESCRIPTION OF THE INVENTION

The invention is directed to a telescoping weather-resistant enclosure that is expandable such that the volume within the enclosure is increased when the cover of the enclosure is extended.

The enclosure comprises a base having sidewalls and a back portion, and a cover having a hinge in an upper portion and a locking tab in a lower portion. The cover includes a top portion connected to opposing endwalls and opposing sidewalls which project downwardly from the top portion to form the cover. Integrated into opposite sidewalls at one end of the cover are projections which act as a hinge and are adapted to form a friction fit with a portion of the base. At the other end of the cover, a locking tab is integrated into an end wall and is placed between two cutouts which form discrete channels through which wires may enter the enclosure.

The sidewalls of the base project upwardly from the back portion and substantially form the box like enclosure. The back portion of the base of the enclosure comprises a planar surface with an irregular cutout portion that includes slots integrated into the cutout portion. The cutout portion is sized and shaped such that the back portion can be placed over an installed electrical device such as a receptacle and moved around the receptacle until the slots in the cutout portion align with the mounting points of the receptacle or electrical device which the enclosure is intended to surround.

Preferably, when the base portion of the enclosure is being oriented around the receptacle or electrical device to be enclosed, the mounting screws of the receptacle or device are loosened so that the slots can easily be urged around the screws or mounting points such that tightening the screws, once the slots are positioned, secures the receptacle or device to the back portion of the enclosure.

At one end of the base portion, adjacent sidewalls have a patterned channel portion that is adapted to receive and loosely retain the hinge formed in one end of the cover while permitting it to slide and rotate. At the other end of the base portion, projections are formed on the exterior of the end wall and positioned such that the locking tab formed n the cover can latch on to the projections.

Figure 1B:
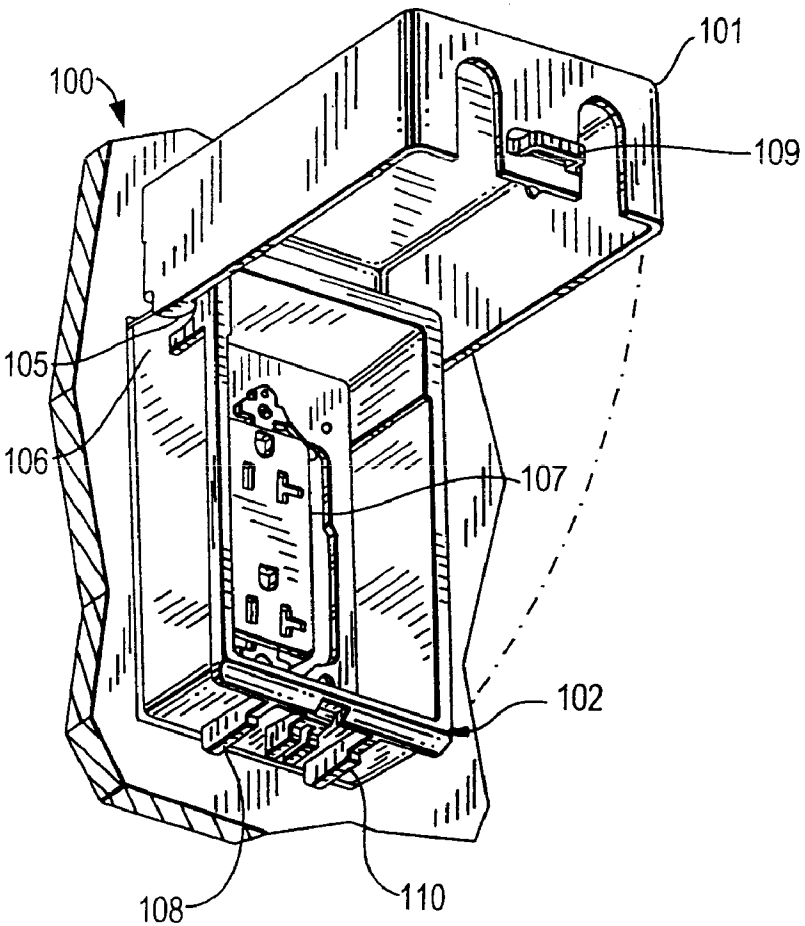
FIG. 1B is another perspective view of an open enclosure in accordance with the present invention.
Figure 1A:
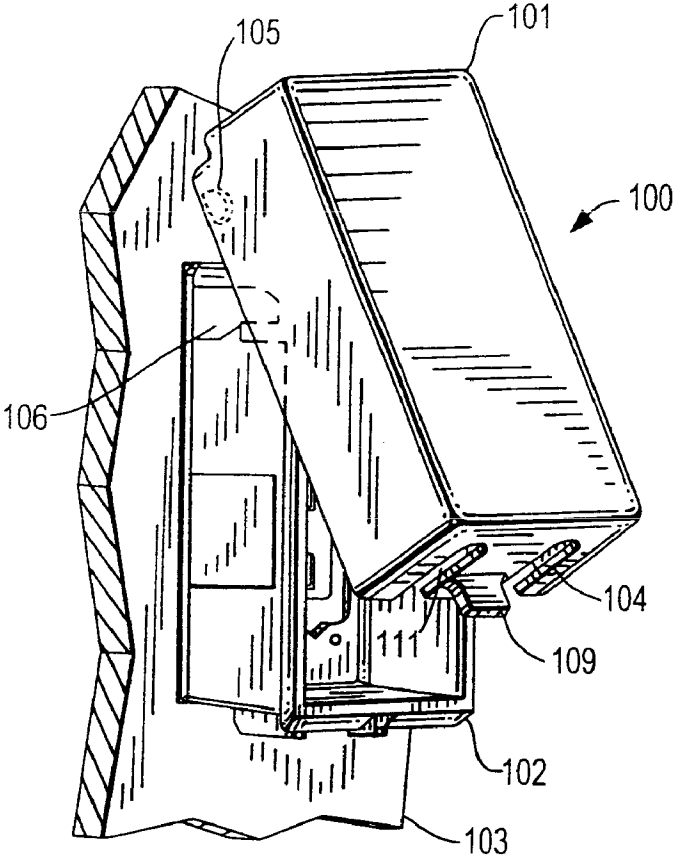
FIG. 1A is a perspective view of an open enclosure in accordance with the present invention.

Referring now to FIG. 1A, depicted therein is a telescoping weather resistant enclosure in accordance with the present invention. As shown, the enclosure 100 comprises a cover 101 having an inwardly projecting hinge pin 105 supported by opposing side wall members and locking tab 109 supported by an end wall formed at opposite ends. The hinge pin 105 is sized to fit channel 106 formed at one end of base portion 102 of the enclosure 100. Turning now to FIG. 1B, depicted therein is enclosure 100 with cover 101 attached. As shown, when fully assembled and installed, base portion 102 encloses an electrical device such as a receptacle 107 or other device and forms the mounting for enclosure 100. When cover 101 is installed on base portion 102 the configuration of channel 106 permits hinge 105 to "float" and freely translate upwardly or downwardly along the lateral extent of channel 106 without binding. Thus, cover 101 is free to rotate about the axis of hinge 105 and loosely translate along the lateral extent of channel 106 as a result of hinge 105 being smaller than channel 106. When cover 101 is rotated downwardly about hinge pin 105, locking tab 109 engages projections 108 and 110 thereby securing cover 101 in the closed position.

Figure 2B:
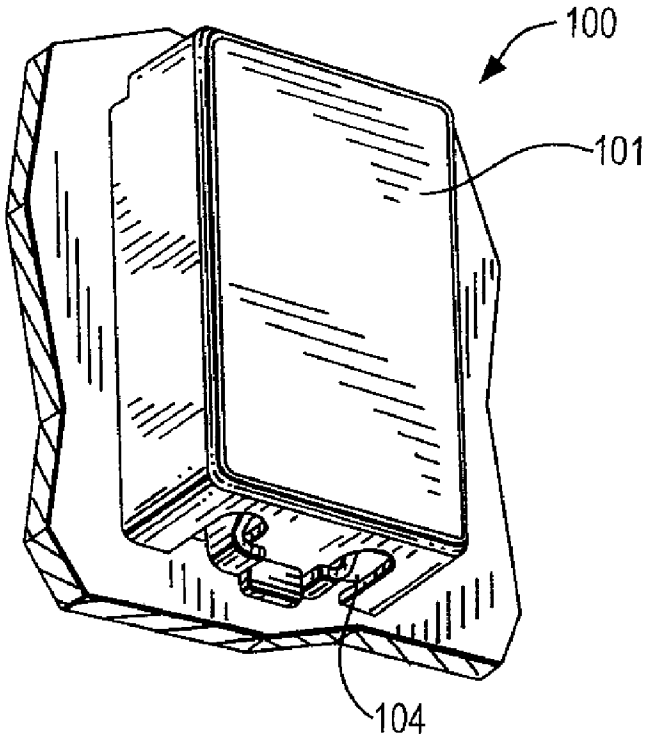
FIG. 2B is a perspective view of a closed enclosure without wires in accordance with the present invention.
Figure 2A:
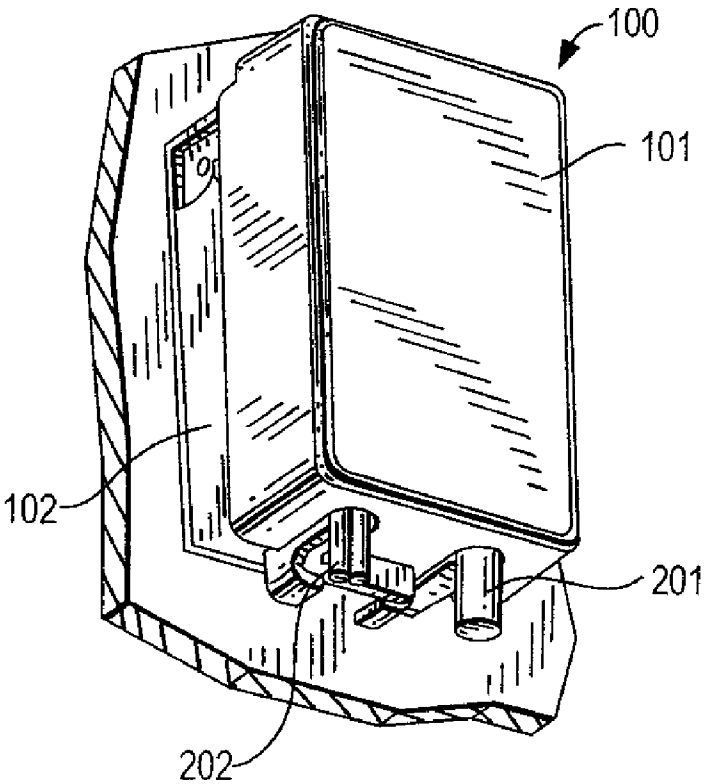
FIG. 2A is a perspective view of a closed enclosure with wires in accordance with the present invention.

FIGS. 2A and 2B show enclosure 100 with cover 101 in the closed position. As shown in FIG. 2A when a receptacle 107 is in use and plugs are plugged into its face, wires 201 and 202 which are associated with plugs inserted in a receptacle 107, are accommodated in slots 104 and 111. In this condition, cover 101 is raised to the extent necessary to allow the plugs associated with wires 202 and 203 to be accommodated. As shown in FIG. 2B, when the receptacle housed within enclosure 100 is not in use cover 101 can be retracted by pushing down on the cover and thereby lowering the profile of enclosure 100.

Figure 3C:
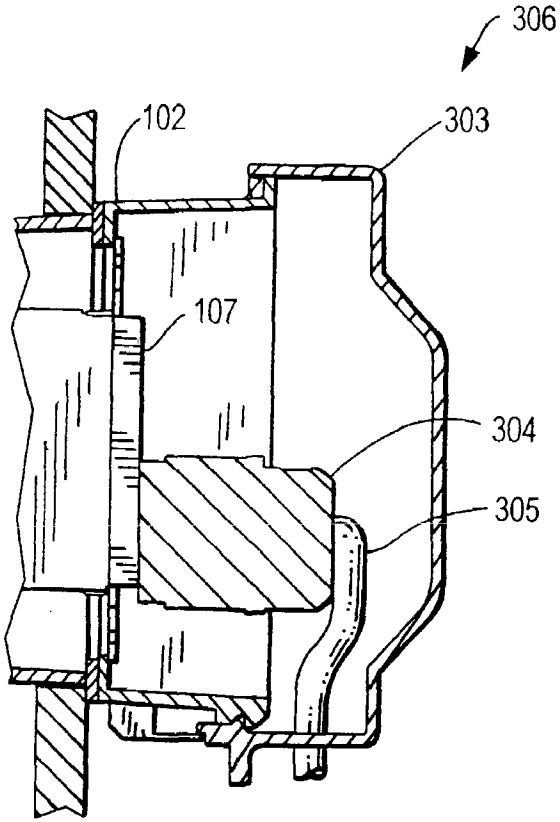
FIG. 3C is a sectional view of an enclosure in accordance with a second embodiment of the present invention with a large plug installed.
Figure 3B:
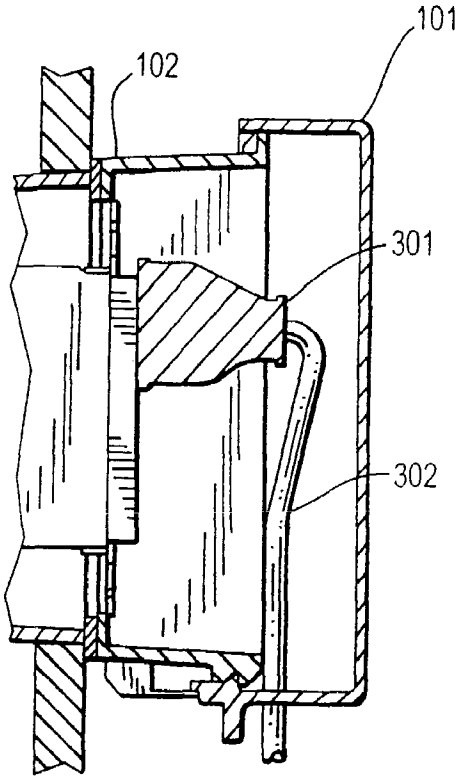
FIG. 3B is a sectional view of an enclosure in accordance with the present invention with a plug installed.
Figure 3A:
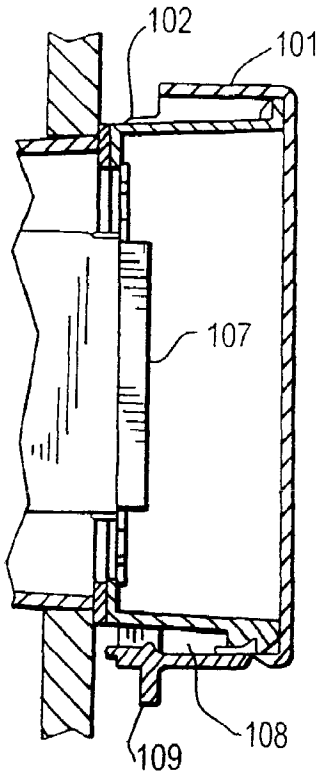
FIG. 3A is a sectional view of an enclosure in accordance with the present invention with the cover fully retracted.

FIGS. 3A-3C provide sectional views of two embodiments of an enclosure in accordance with the present invention. As is shown in FIG. 3A, when no plugs are plugged into receptacle 107 cover 101 can be pushed down to its lowest extent over base portion 102 thereby lowering the profile of enclosure 100. When a plug 301 is inserted into receptacle 107 as shown in FIG. 3B, cover 101 is correspondingly raised to provide room within the enclosure 100 for the plug 301 and its associated wire 302. When it is necessary to extend the cover 101, locking tab 109 engages projection 108 to prevent cover 101 from rotating around hinge 105. When it is necessary to access the receptacle 107 however, a simple pull on tab 109 permits rotation of the cover 101 about hinge 105, thereby permitting access to the interior of enclosure 100.

FIG. 3C depicts a second embodiment of an enclosure in accordance with the present invention. As shown, a second embodiment of the present invention comprises all the elements of the enclosure 100 discussed in conjunction with FIGS. 1A-3B but with a domed cover 303. By forming the cover with a dome, a larger plug 304 and wire 305 can be inserted into receptacle 107 and fully contained within enclosure 306.

Figure 4C:
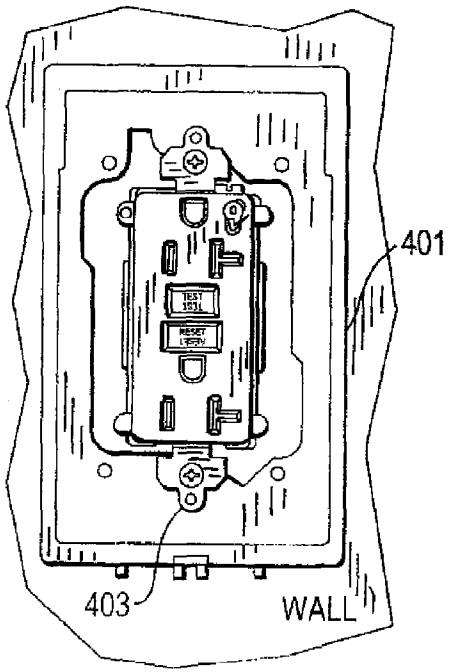
FIG. 4C is yet another planar view of the base of an enclosure in accordance with the present invention being installed around a wall mounted receptacle.
Figure 4B:
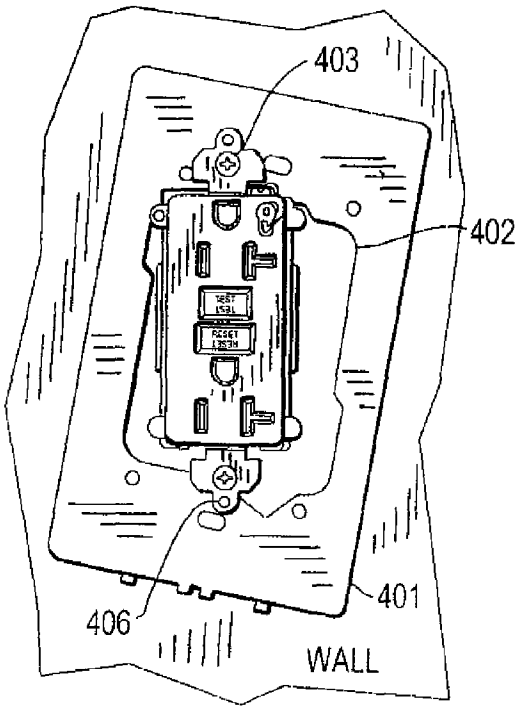
FIG. 4B is a planar view of the base of an enclosure in accordance with the present invention being installed around a wall mounted receptacle.
Figure 4A:
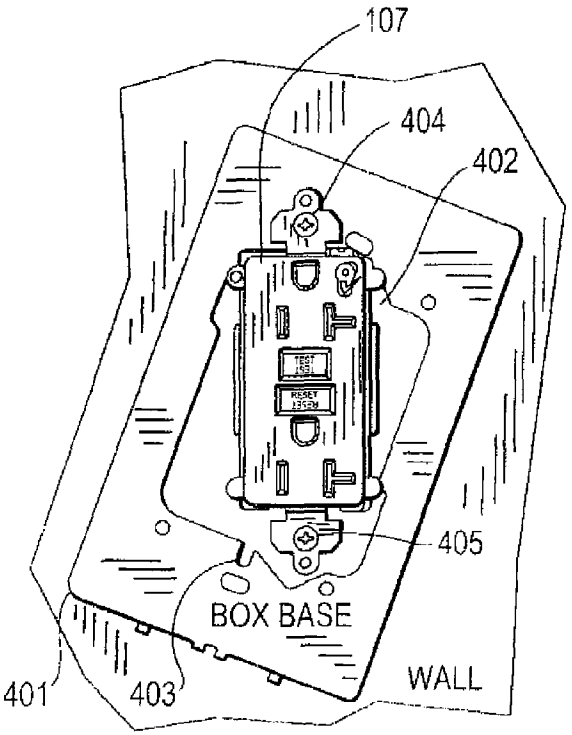
FIG. 4A is a planar view of the base of an enclosure in accordance with the present invention being installed around a wall mounted receptacle.

To mount an enclosure in accordance with the present invention over an electrical device or receptacle, the base portion 102 shown in FIG. 1A must be mounted using the mounting screws of the receptacle or device to be enclosed by the enclosure. This process is depicted in FIGS. 4A-4C. As is shown in FIG. 4A, to install the enclosure, base portion 401 is oriented over a receptacle 107. Receptacle mounting screws 405 and 404 are loosened, and base portion 401 is urged into place, by aligning mounting slots 403 and 406 with mounting screws 404 and 405 as shown in FIGS. 4B and 4C and then securing base 401 to the receptacle 107 and the wall to which it is attached, by tightening screws 404 and 405.

The key to the installation sequence depicted in FIGS. 4A-4C is the irregularly shaped cutout 402 in base portion 401 and slots 403 and 406 which are integrated into the cutout 402. as can be seen in FIGS. 4A-4C the irregular shape of cutout 402 permits the base portion 401 to be moved around to a considerable degree. This is a useful capability when trying to orient the base portion around an already installed electrical device. Moreover, by having the cutout 402 incorporate the mounting slots 403 and 406 along its edge, sliding the base portion 401 over mounting screws 404 is made easy once base portion 401 is oriented around the electrical device or receptacle to be housed within the enclosure. Another benefit of the cutout 402 is that it permits the enclosure of the present invention to be mounted over any standard wiring device such as a switch, or Ground Fault Circuit Interrupter for example. Thus, once an enclosure is secured to a device, the installation is completed by simply affixing the wall plate of the receptacle or other electronic device to the device or receptacle.

Figure 5B:
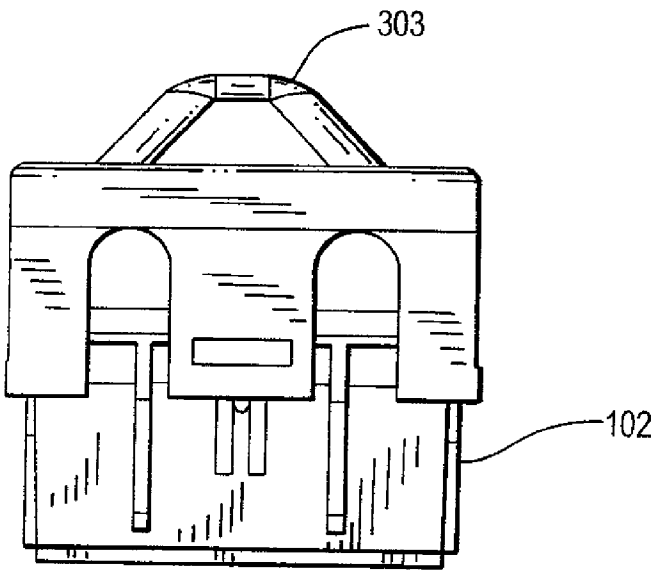
FIG. 5B is a view of the bottom of an enclosure in accordance with a second embodiment of the present invention.
Figure 5A:
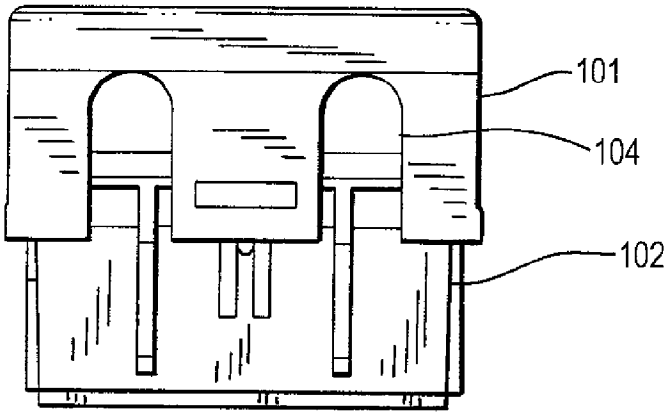
FIG. 5A is a view of the bottom of an enclosure in accordance with the present invention.

Turning now to FIGS. 5*a* and 5B, telescoping enclosures in accordance with a first and second embodiment of the present invention are shown with their covers in the fully extended position. In the first embodiment shown in FIG. 5A, the height of the enclosure with the cover 101 fully extended is preferably about 2.85 inches. For an enclosure in accordance with a second embodiment of the invention with cover 303 fully extended, the profile is preferably 3.51 inches.

Figure 6B:
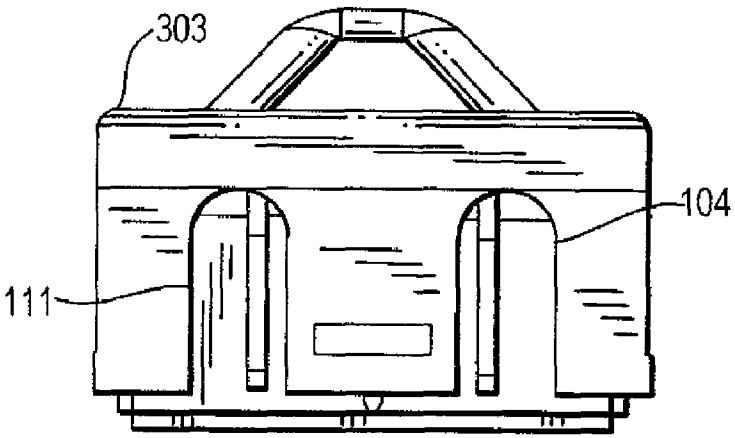
FIG. 6B is a view of the bottom of an enclosure in accordance with a second embodiment of the present invention with the cover fully retracted.
Figure 6A:
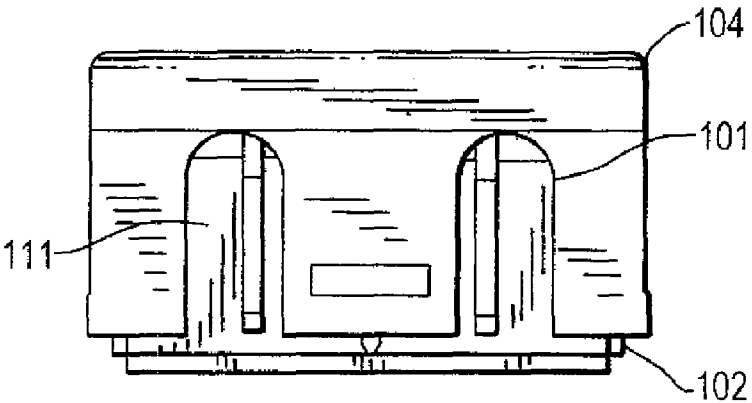
FIG. 6A is a view of the bottom of an enclosure in accordance with the present invention with the cover fully retracted.

Referring now to FIG. 6A, when the cover 101 of an enclosure in accordance with a first embodiment is fully retracted the profile of the enclosure is about 1.86 inches. In contrast when the cover 303 of an enclosure in accordance with a second embodiment is fully retracted, the profile of the enclosure is preferably reduced to 2.52 inches. It should be noted, that in both embodiments of the present invention, the when the covers 101 and 301 are fully retracted as shown in FIGS. 6A and 6B, slots 104 and 111 are sealed off by the covers.

While there have been shown and described and pointed out the fundamental novel features of the invention as applied to the preferred embodiments, it will be understood that various omissions and substitutions and changes of the form and details of the method and apparatus illustrated and in the operation may be done by those skilled in the art, without departing from the spirit of the invention.

The invention claimed is:

1. A weather resistant enclosure for housing an electrical device comprising:

a base portion, said base portion comprising a back wall, said back wall having an irregularly shaped cutout portion having mounting slots integrated therein;

a pair of opposing side walls projecting from said back wall each having a protrusion defining an elongated recessed channel for receiving a hinge pin therein, each of said protrusions defining for each channel an inner surface, each of said inner surfaces being coplanar with a respective one of said side walls;

a pair of opposing end walls projecting from said back wall, at least one of said end walls having at least one projection;

a cover having a front portion, a pair opposing end walls projecting from the front portion and a pair of opposing side walls projecting from the front portion;

each one of said walls further having the hinge pin formed near one end;

said end walls further comprising a locking tab, wherein, when said hinge pins on said cover are brought into corresponding contact with said elongated recessed channels in the pair of opposing side walls projecting from the back wall each of said hinge pins is friction fit to one of said side walls and forms a floating hinge having rotation and sliding ability between said cover and said base, wherein, the configuration of each of said elongated recessed channels permits each of said hinge pins to translate upwardly or downwardly along said elongated recessed channels without binding; and wherein, the cover can pivotly open and close about the base portion and simultaneously or separately telescope toward and away from the base portion to decrease and increase the distance between the back wall of the base portion and the front portion of the cover.

2. The weather resistant enclosure for housing an electrical device according to claim 1, wherein the inner surface is arcuate.

3. The weather resistant enclosure for housing an electrical device according to claim 1, wherein said base portion includes at least one cutout for enabling at least one wire to pass there through and enter the enclosure.

4. The weather resistant enclosure for housing an electrical device according to claim 1, wherein said cover is domed.

5. The weather resistant enclosure for housing an electrical device according to claim 1, wherein said locking tab includes at least two projections.

6. The weather resistant enclosure for housing an electrical device according to claim 1, wherein said locking tab of said cover is configured to prevent said cover from rotating around said hinge.

7. The weather resistant enclosure for housing an electrical device according to claim 1, wherein said locking tab of said cover is configured to engage said at least one projection when said cover is in a closed position.

8. The weather resistant enclosure for housing an electrical device according to claim 1, wherein the cover is configured to be raised and lowered along an axis perpendicular to said base portion to vary the profile of said enclosure.

9. The weather resistant enclosure for housing an electrical device according to claim 1, wherein said base portion is configured for receiving at least one mounting member for mounting said base portion to a surface.

* * * * *